United States Patent [19]

Komossa et al.

[11] 4,016,971

[45] Apr. 12, 1977

[54] CONVEYOR FOR USE IN TOBACCO SHREDDING APPARATUS

[75] Inventors: Werner Komossa, Bornsen; Werner Neustadt; Gerhard Tolasch, both of Hamburg, all of Germany

[73] Assignee: Hauni-Werke Körber & Co., KG, Hamburg, Germany

[22] Filed: Feb. 27, 1975

[21] Appl. No.: 553,901

[30] Foreign Application Priority Data

Mar. 8, 1974 Germany ..... 2411117

[52] U.S. Cl. ..... 198/850; 100/151

[51] Int. Cl.[2] ..... B65G 15/30

[58] Field of Search ..... 198/195, 196, 197, 165, 198/850; 100/151, 152

[56] References Cited

UNITED STATES PATENTS

| | | | |
|---|---|---|---|
| 853,129 | 5/1907 | Simpson | 198/195 |
| 3,722,743 | 3/1973 | Atchley | 198/195 |

FOREIGN PATENTS OR APPLICATIONS

| | | | |
|---|---|---|---|
| 1,099,920 | 2/1961 | Germany | 198/195 |

*Primary Examiner*—Johnny D. Cherry
*Assistant Examiner*—Douglas D. Watts
*Attorney, Agent, or Firm*—Peter K. Kontler; John Kurucz

[57] ABSTRACT

A link chain which transports and compacts tobacco leaves in a tobacco shredding apparatus has a succession of neighboring metallic links each of which has a trailing end provided with a cylindrical male coupling portion extending into and turnable in a complementary socket at the leading end of the next-following link. The socket is formed at the inner side and the coupling portion is at the outer side of the respective link. Each outer side has a convex cylindrical surface at its front end, and such surface slides along a complementary concave cylindrical surface at the rear end of the outer side of the preceding link. Each link is further formed with a scraping edge which cleans the convex cylindrical surface of the next-following link. The convex cylindrical surface of each link bounds a portion of a recess which is formed in the outer side and is adjacent to the coupling portion of the respective link. The outer side is fluted to enhance the transport of tobacco leaves into the range of a comminuting device, and the inner side has a pair of protuberances bounding the respective socket and a tooth space which is disposed between the socket and the coupling portion.

8 Claims, 3 Drawing Figures

CONVEYOR FOR USE IN TOBACCO SHREDDING APPARATUS

BACKGROUND OF THE INVENTION

The present invention relates to apparatus for comminuting fibrous material, especially tobacco, and more particularly to improvements in conveyors which can be used in apparatus for shredding tobacco leaves or the like to compact tobacco and to advance compacted tobacco into the range of one or more orbiting knives forming part of a comminuting device.

A tobacco shredding apparatus normally comprises a comminuting device including a rotary drum-shaped carrier for orbiting knives and a system of convergent chains which advance tobacco leaves into the range of the knife or knives. As a rule, the chains define a chamber whose height decreases in the direction of tobacco transport so that the leaves which are fed into the inlet of the chamber are compacted and form a continuous cake not later than when they reach the outlet of the chamber. The links of conventional chains normally consist of drawn corrosion-resistant metal and resemble plates which are pivotally connected to each other by pintles or the like. Chains which employ such plate-like hingedly-connected links must be provided or used with specially designed auxiliary devices which prevent penetration of portions of tobacco leaves and/or tobacco juice and/or other adhesive liquid or water-soluble ingredients of tobacco. Penetration of tobacco leaves and/or liquid ingredients of tobacco into the spaces between neighboring plate-like links of conventional chains is highly undesirable, not only when the tobacco leaves do not contain or carry any casing but especially when the leaves are contacted with casing prior to introduction into the shredding apparatus. The casing tends to adhere to and to accumulate on component parts of the chains so that the links are likely to jam, i.e., they cannot pivot or pivot only within limits relative to each other. The resulting greatly increased friction can be overcome only by resorting to powerful prime movers whose energy requirements are excessive as well as to frequent cleaning of links.

Certain proposals to improve the construction of link chains which are used for the compacting and transport of tobacco in shredding and analogous comminuting apparatus are disclosed in German Pat. No. 1,183,014. This patent proposes to employ chains having several types of links and to provide sealing elements in the form of strips or the like. Such chains are complex and expensive; furthermore, they cannot satisfactorily prevent escape of tobacco juice and/or blocking of links by accumulations of casing and/or portions of tobacco leaves.

SUMMARY OF THE INVENTION

An object of the invention is to provide a novel and improved conveyor which can be used to compact and advance tobacco leaves into the range of the comminuting device in a tobacco shredding aparatus or the like.

Another object of the invention is to provide the conveyor with a novel and improved link chain whose links are relatively simple and invariably or practically invariably prevent the escape of ingredients of tobacco leaves and/or jamming of the chain by fragments of conveyed material.

A further object of the invention is to provide a novel and improved chain which is assembled of identical links, which need not be provided with discrete sealing devices to prevent escape of the ingredients of conveyed material, and which can be used with advantage as a superior substitute for tobacco advancing and compacting chains in tobacco shredding apparatus.

An additional object of the invention is to provide a link chain whose links are provided with self-cleaning means and whose links are less likely to be blocked or contaminated by tobacco juice, casing and/or fragments of tobacco leaves than the links of conventional chains.

The invention is embodied in a conveyor, particularly in a conveyor which can be used to compact tobacco and to advance compacted tobacco into the range of a comminuting device, e.g., a comminuting device having a rotary drumshaped carrier for one or more knife blades which cooperate with a counterknife (such as one section of an adjustable mouthpiece) to shred whole or destalked tobacco leaves.

The improved conveyor comprises an endless flexible element (preferably a metallic link chain) which is arranged to travel in a predetermined direction and comprises a plurality of interengaged neighboring links each of which has a leading end and a trailing end, as considered in the aforementioned direction, a tobacco-contacting outer side, an inner side which is formed with a tooth space for the teeth of a sprocked wheel, a substantially cylindrical male coupling portion at one of the ends (e.g., at the trailing end) and a complementary socket at the other end. The socket of each link receives the coupling portion of the neighboring link and each link further comprises a protuberance adjacent to its socket and having a cylindrical first surface which is preferably a convex surface. Each link further includes a complementary second surface which is adjacent to the coupling portion and the first surface of each link is in sliding engagement with the second surface of the neighboring link. The coupling portion and protuberance of each link extend transversely of the aforementioned direction.

The outer side of each link is preferably formed with a scraping edge which is adjacent to the respective second surface and moves along and cleans the first surface of the neighboring link when the neighboring links pivot with respect to each other. The coupling portions preferably fill the respective sockets so that the sockets cannot receive and store fragments of tobacco leaves and/or liquid ingredients of tobacco.

The novel features which are considered as characteristic of the invention are set forth in particular in the appended claims. The improved conveyor itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
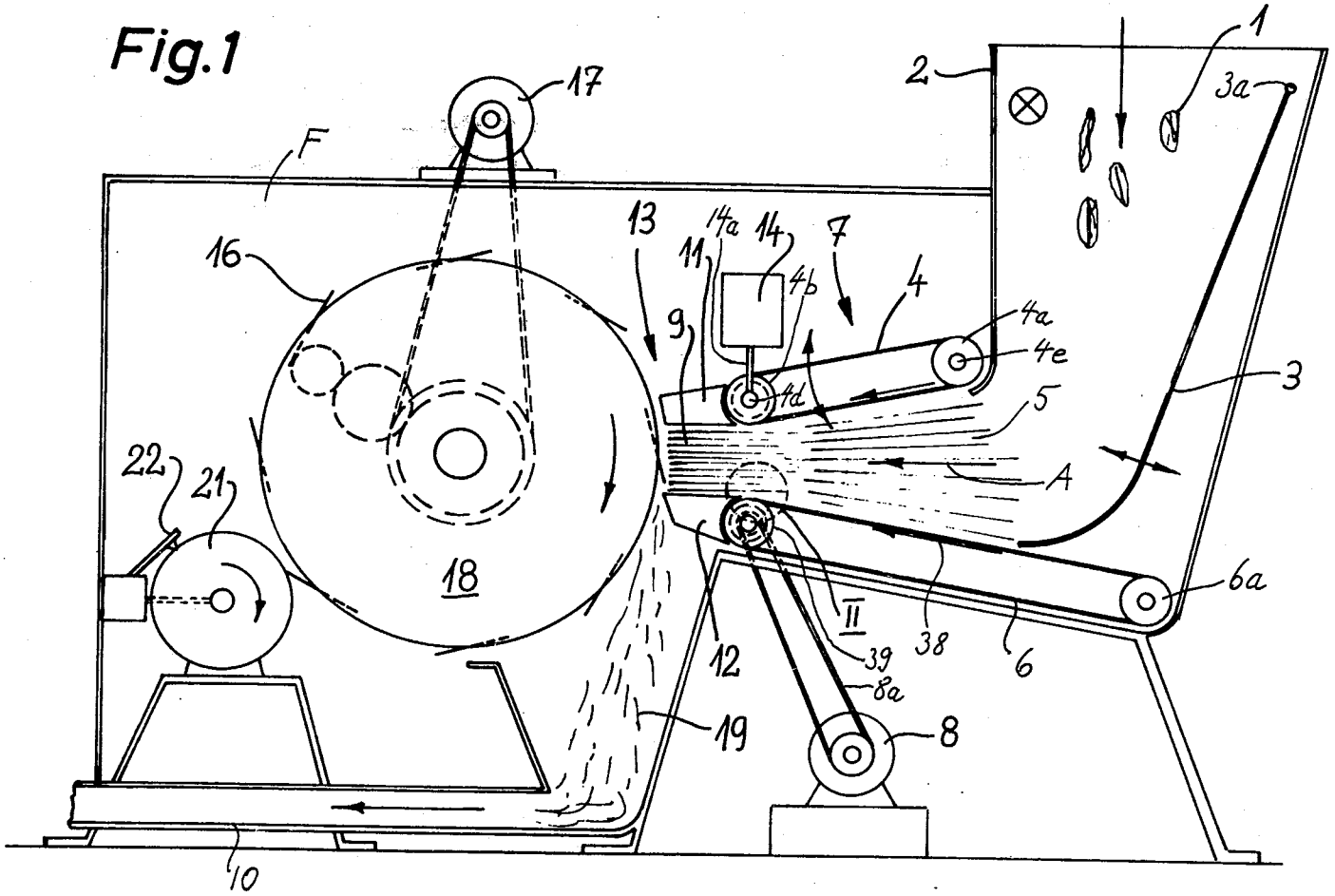
FIG. 1 is a schematic partly elevational and partly longitudinal vertical sectional view of a tobacco shredding apparatus including two conveyors each of which embodies the invention.

FIG. 1 shows a tobacco shredding apparatus similar to that known as type KT sold by Hauni-Werke Körber & Co. KG., of Hamburg, Western Germany. The apparatus is connected to a suitable source (e.g., a conveyor serving to transport tobacco leaves from a bale breaker) which discharges discrete tobacco leaves 1 and/or batches of coherent tobacco leaves into an upright duct 2. The duct 2 contains a rake 3 which is pivoted (as at 3a) at regular or irregular intervals to feed the descending leaves 1 into the space or chamber 5 between the lower stretch or reach of a first or upper endless chain 4 and the upper stretch or reach of a second or lower endless chain 6. The height of the chamber 5 decreases as considered in the direction (arrow A) of tobacco feed into an adjustable mouthpiece 13 having an upper section 11 and a lower section 12. The chains 4 and 6 form part of a tobacco-compacting and advancing conveyor system 7 which converts the leaves 1 into a continuous cake 9. The chain 4 is trained over a fixedly mounted idler sprocket wheel **4*a* and an adjustable sprocket wheel 4*b*. The shaft 4*d* of the sprocket wheel 4*b* is attached to the lower end of a piston rod 14*a* forming part of a fluid-operated motor 14** whose cylinder is articulately connected to the housing F.

The shaft **4*d* is further mounted in a frame (not specifically shown) which is pivotable about the axis of the shaft 4*e* for the sprocket wheel 4*a***.

The chain 6 is trained over a rear sprocket wheel **6*a* and a front sprocket wheel 39 (see also FIG. 2) which latter is driven by a discrete prime mover 8 (e.g., a variable-speed electric motor) through the medium of a chain 8*a* so that the upper stretch of the chain 6 advances in the direction indicated by arrow 38. The output element of the prime mover 8 can further drive one sprocket wheel for the chain 4. The fluid (e.g., oil) in the cylinder of the motor 14 urges the piston rod 14*a* downwardly, as viewed in FIG. 1, so as to subject the leaves 1** to a desired compacting action.

The lower section 12 of the mouthpiece 13 constitutes a stationary counterknife for a series of knife blades 16 which are mounted at the periphery of a drum-shaped carrier 18 driven by a discrete second prime mover 17 (e.g., a variable-speed electric motor). When the prime movers 8, 17 are on and the source supplies leaves 1 into the duct 2, the resulting cake 9 is severed by successive blades 16 to yield shreds or strands 19 which descend by gravity and enter the inlet of a pneumatic conveyor 10. The latter can transport shreds to a conditioning apparatus, to storage or to another destination.

The blades 16 are sharpened by a grinding wheel 21 which is driven by a further motor (not shown) and is preferably reciprocable in parallelism with the axis of the carrier 18 to grind the blades 16 along the full length of their cutting edges. The reference character 22 denotes a support for a diamond which serves as a means for dressing the working surface of the grinding wheel 21.

Figure 2:
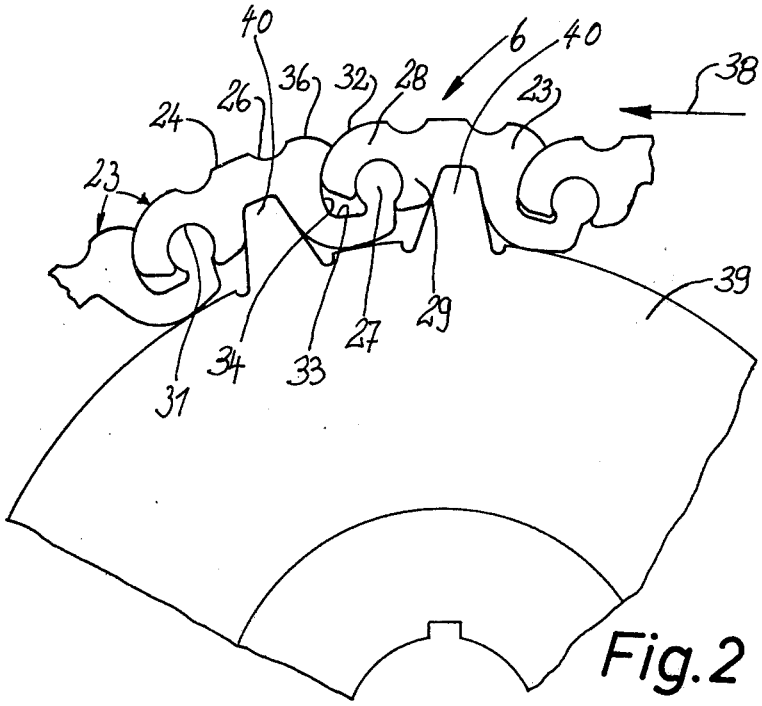
FIG. 2 is an enlarged view of a detail in the apparatus of FIG. 1.
Figure 3:
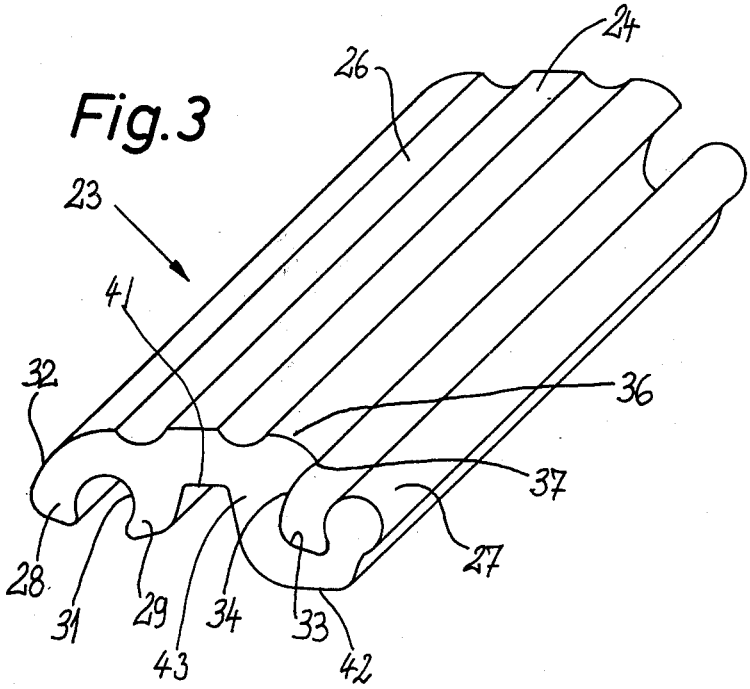
FIG. 3 is an enlarged perspective view of a link forming part of one of the improved conveyors.

FIG. 2 shows on a larger scale a detail within the broken-line circle II of FIG. 1. The chain 6 is assembled by a series of identical neighboring metallic links 23 (one shown in a perspective view in FIG. 3) which are interlinked or interlaced with each other in a novel way to provide a substantially liquid-tight endless loop. The construction of the chain 4 is preferably identical with or analogous to that of the chain 6, and the sprocket wheels **4*a*, 4*b* and 6*a* are preferably similar to or identical with the sprocket wheel 39**.

Each link 23 of the chain 4 or 6 comprises a tobacco-contacting outer side 24 which, while the respective link engages tobacco leaves 1, faces the chamber 5. The outer side 24 may be provided with relatively shallow flutes 26 which are but need not be exactly normal to the direction indicated by arrow 38 and serve to contribute to the ability of the link to grip and positively advance the adjacent leaves 1. A link 23 which engages the adjacent leaves 1 or the fully compacted cake 9 leaves the upper stretch of the chain 6 while moving between the section 12 and sprocket wheel 39. The trailing or rear end (i.e., the right-hand end, as viewed in FIG. 2) of each link comprises a substantially rod-like male coupling portion 27 which is parallel to the axis of the sprocket wheel 39 and is bounded by a cylindrical surface. The front or leading end of each link 23 is formed with a substantially cylindrical female portion or socket 31 bounded by the concave surfaces of two rib-like protuberances 28, 29. The surface surrounding the socket 31 is complementary to the cylindrical surface of the male portion 27 forming part of a neighboring link 23, and the width of the open side of the socket 31 is sufficient to allow for requisite pivotal movement of neighboring links with respect to each other. The male portion 27 and the socket 31 are disposed at the opposite sides of the respective link 23, and the protuberances 28, 29 are parallel to the male portion 27. Each male portion 27 constitutes a fulcrum for that link 23 whose socket 31 receives such male portion, and each link is further formed with a cylindrical end surface 32 (on the protuberance 28) which can engage and slide along a complementary concave surface 34 in a recess or groove 33 of the neighboring link. The groove 33 is adjacent to the male portion 27. The concave surface 34 extends inwardly from a convex end surface 36 of the respective outer side 24, and the surfaces 34, 36 define a relatively sharp scraping edge 37 which can remove juice and other matter adhering to the surface 32 of the adjoining link 23. The surface 32 merges into the front end and the surface 36 merges into the rear end of the respective outer side 24. The area of contact between the surfaces 32, 34 of two neighboring links is sufficiently large to provide a desirable sealing action and to thus prevent penetration of juice into the respective groove 33. The surfaces 32, 34, 36 of each link 23 preferably constitute portions of cylindrical surfaces. The radius of curvature of the surface 36 preferably matches that of the surface 32. The surface 34 further cooperates with the scraping edge 37 of the neighboring link 23 to prevent penetration of tobacco leaves 1 (or their fragments) into the respective groove 33. This reduces the likelihood of jamming of the chain 6 (i.e., its links 23 are less likely to adhere to each other in regions where the male portions 27 of preceding links enter the female portions 31 of the next following links).

When a link 23 travels around the sprocket wheel 39, the adjacent tooth 40 of the sprocket wheel enters a tooth space 41 in that (inner) side (42) of the link 23 which faces away from the surface 24. The tooth space 41 is disposed between the protuberance 29 and that portion (43) of the link 23 which is formed with the surface 34. The surface 32 of a trailing link 23 then moves outwardly along the surface 34 of the preceding link; once the link moves beyond the sprocket wheel 39, the surface 32 moves in the opposite direction and is thereby cleaned by the edge 37 of the preceding link. Thus, the surface 32 cooperates with the edge 37 to prevent clogging of the recess 33 and the penetration of juice to the inner side 42 in the region where two neighboring links pivot with respect to each other. Penetration of juice or solids into the socket 31 is prevented because the latter is completely filled by the respective male portion 27.

An advantage of the improved chain is that it employs identical links which are directly coupled to each other to provide a practically continuous outer side and which are interlinked in such a way that they prevent jamming and/or penetration of tobacco ingredients to the inner side of the chain. Moreover, the links which reach the sprocket wheel 39 move away from the cake 9 without entraining any tobacco particles and each of these links is automatically cleaned by the scraping edge 37 of the neighboring link to prevent the accumulation of crusts in the critical regions where such accumulations would reduce the flexibility of the chain. Furthermore, the outer sides of the links insure that the leaves do not lag behind the links so that the cake can be advanced at a predictable rate.

The cylindrical surfaces 36 (whose radii of curvature preferably equal those of the surfaces 32, 34) insure that the outline of the combined outer side of the chain 6 equals or closely approximates the ideal outline. Moreover, these surfaces define relatively sharp cutting edges because they are adjacent to the concave surfaces 34 of the respective links.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. (REPLACES THE CLAIMS 10 AND 11) In a conveyor for compacting tobacco and for advancing compacted tobacco into the range of a comminuting device, an endless flexible element arranged to travel in a predetermined direction and comprising a plurality of interengaging neighboring links, each of said links having a leading end and a trailing end, as considered in said direction, a tobacco-contacting outer side, an inner side, a substantially cylindrical male coupling portion provided in said outer side at one of said ends and a complementary socket provided in said inner side at the other of said ends, the socket of each link receiving the coupling portion of the neighboring link and each coupling portion substantially filling and being turnable in the corresponding socket, each link further comprising a first protuberance adjacent to said socket and having a cylindrical first surface and each link also having a complementary second surface adjacent to said coupling portion, said first surface being in permanent sliding engagement with the second surface of the neighboring link to shield the coupling portion in the corresponding socket against entry of foreign matter and said coupling portion and first protuberance of each link extending transversely of said direction, each of said links further comprising a second protuberance and said socket being disposed between said first and second protuberance of the respective link, said first and second protuberance being disposed at said inner side and said inner side further having a tooth space between said second protuberance and said coupling portion of the respective link.

2. A flexible element as defined in claim 1, wherein said first surfaces merge into said outer sides of the respective links.

3. A flexible element as defined in claim 2, wherein each of said links has a recess adjacent to the respective coupling portion and extending inwardly from the respective outer side, said second surface bounding the recess of the respective link.

4. A flexible element as defined in claim 3, wherein each of said second surfaces defines with the outer side of the respective link a scraping edge which moves relative to the first surface of the neighboring link.

5. A flexible element as defined in claim 4, wherein the outer side of each link has a cylindrical third surface which is adjacent to the respective scraping edge.

6. A flexible element as defined in claim 1, wherein the radius of curvature of each third surface equals the radius of curvature of each second surface.

7. A flexible element as defined in claim 1, wherein each of said second surfaces is a concave surface.

8. A flexible element as defined in claim 1, wherein said one end is the trailing end of the respective link, each of said first surfaces is a convex surface, and each of said second surfaces is a concave surface having a radius of curvature substantially identical with the radius of curvature of the first surface.

* * * * *